US008144101B2

(12) United States Patent
Lebrun

(10) Patent No.: US 8,144,101 B2
(45) Date of Patent: Mar. 27, 2012

(54) LIQUID-CRYSTAL MATRIX DISPLAY

(75) Inventor: Hugues Lebrun, Coublevie (FR)

(73) Assignee: Thales, Neuilly-sur-Seine (FR)

( * ) Notice: Subject to any disclaimer, the term of this patent is extended or adjusted under 35 U.S.C. 154(b) by 997 days.

(21) Appl. No.: 11/632,292

(22) PCT Filed: Jul. 12, 2005

(86) PCT No.: PCT/EP2005/053320

§ 371 (c)(1),
(2), (4) Date: Jan. 12, 2007

(87) PCT Pub. No.: WO2006/005749

PCT Pub. Date: Jan. 19, 2006

(65) Prior Publication Data

US 2007/0252780 A1 Nov. 1, 2007

(30) Foreign Application Priority Data

Jul. 13, 2004 (FR) ..... 04 07813

(51) Int. Cl.
*G09G 3/36* (2006.01)

(52) U.S. Cl. ..... 345/98; 345/87; 345/204

(58) Field of Classification Search ..... 345/87–100, 345/204

See application file for complete search history.

(56) References Cited

U.S. PATENT DOCUMENTS 5,347,378 A * 9/1994 Handschy et al. ..... 349/78
5,945,972 A * 8/1999 Okumura et al. ..... 345/98
6,049,367 A * 4/2000 Sharp et al. ..... 349/117
6,175,351 B1 * 1/2001 Matsuura et al. ..... 345/98
6,181,311 B1 * 1/2001 Hashimoto ..... 345/98
6,359,608 B1 3/2002 Lebrun et al.
6,611,311 B1 8/2003 Kretz et al.
6,924,785 B1 8/2005 Kretz et al.
6,972,747 B2 12/2005 Bayot et al.
6,977,638 B1 12/2005 Bayot et al.
2002/0024618 A1 * 2/2002 Imai ..... 348/743

FOREIGN PATENT DOCUMENTS

EP 0 509 727 10/1992

(Continued)

OTHER PUBLICATIONS

U.S. Appl. No. 10/480,151, filed Dec. 10, 2003, Lebrun.

(Continued)

*Primary Examiner* — Alexander Eisen
*Assistant Examiner* — Viet Pham
(74) *Attorney, Agent, or Firm* — Oblon, Spivak, McClelland, Maier & Neustadt, L.L.P.

(57) ABSTRACT

A liquid crystal matrix display includes a matrix driver delivering at least a first frame section signal and a second frame selection signal and a first write device and a second write device associated with each pixel element of the matrix, wherein one of the write devices is connected to the associated selection line of the pixel element, and the other is connected to another selection line of the matrix. The write devices have crossed sample and transfer commands, the first frame selection signal causing sampling in the first write device, and contacting of information already sampled in the second write device with the pixel element, the second frame selection signal causing sampling in the second write device, and contacting of information already sampled in the first write device with the pixel element.

15 Claims, 4 Drawing Sheets

FOREIGN PATENT DOCUMENTS

| | | |
|---|---|---|
| EP | 1 026 658 | 8/2000 |
| EP | 1 298 636 | 4/2003 |
| JP | 3 64791 | 3/1991 |
| JP | 2000-56334 | 2/2000 |
| WO | 2004 001715 | 12/2003 |

OTHER PUBLICATIONS

U.S. Appl. No. 12/063,359, filed Feb. 8, 2008, Lebrun, et al.
U.S. Appl. No. 11/997,679, filed Feb. 1, 2008, Lebrun et al.
U.S. Appl. No. 12/049,747, filed Mar. 17, 2008, Kretz, et al.
U.S. Appl. No. 12/096,470, filed Jun. 6, 2008, Lebrun, et al.
U.S. Appl. No. 12/096,381, filed Jun. 6, 2008, Lebrun, et al.
Japanese Office Action issued Mar. 15, 2011, in Patent Application No. 2007-520828 (English-language translation only).

* cited by examiner

| | Frame 1 | | | Frame 2 | | | |
|---|---|---|---|---|---|---|---|
| $Latch_A$ | Frame R 1 | Frame V 0 | Frame B 1 | Frame R 0 | Frame V 1 | Frame B 0 | Frame R 1 |
| $Latch_B$ | 0 | 1 | 0 | 1 | 0 | 1 | 0 |

LIQUID-CRYSTAL MATRIX DISPLAY

BACKGROUND OF THE INVENTION

Field of the Invention

The present invention relates to a matrix display comprising a write device that allows a colour sequential mode for addressing the matrix. In such a mode, the data of a red frame, then of a green frame, then of a blue frame are caused to be successively displayed by the matrix, so as to obtain a colour image. Each video display frame thus comprises three colour frames.

Such a display system is used notably for reducing the cost of colour video image projection systems by limiting the number of displays and by limiting the optical equipment to that required by the single display employed. The colour image is formed on the LCD matrix screen that is illuminated successively by three different colours, red, green, blue, for example by means of a disc whose surface is divided into segments of different colours in the illuminating beam.

Other applications are targeted, such as for example applications using virtual reality systems (LCD projection systems for compact systems of the 'near-to-eye' type). In this field, a major problem is the size of the system. The use of a single system for displaying virtual images provides a well-adapted solution.

DISCUSSION OF THE BACKGROUND

Considering a conventional matrix display used in the usual manner to display a monochrome image, the writing of information into the pixel elements requires only one write device per pixel element. Each pixel element is linked to a selection line corresponding to a row of the matrix and a data line corresponding to a column of the matrix. This write device is typically a sample-and-hold device whose command for storing a data bit presented at the input on the column is generated by the activation of the sampler by the selection line. The image is thus sequentially refreshed by successive activation of the selection lines.

An example of such a write device is shown in FIG. 1. In this figure, two pixel elements $XL_{i,j}$, and $XL_{i,j+1}$, of the same matrix row i, are shown. These pixel elements are linked to the selection line $L_i$, and to a respective data line, $Col_j$ for the pixel element $XL_{i,j}$, and $Col_{j+1}$ for the pixel element $XL_{i,j+1}$, by a respective write device, $W_{i,j}$ for the pixel element $XL_{i,j}$, and $W_{i,j+1}$ for the pixel element $XL_{i,j+1}$.

Each pixel element is represented by its equivalent capacitance, denoted $C_{XL}$, in parallel with the additional storage capacitor Csto, which is generally included since the value of $C_{XL}$ is generally too small to allow the information to be held for the whole frame time. In one example, the capacitance $C_{XL}$ is around 1.5 femtofarads, and the capacitor Csto has a value of around 50 femtofarads, allowing the various losses from the structure to be compensated.

Each write device, for example $W_{i,j}$ is a sample-and-hold circuit. In the example, this circuit comprises a switching transistor T1 connected between the data line $Col_j$ and the pixel element $XL_{i,j}$. The transistor T1 has its gate connected to the selection line $L_i$, and one electrode (source or drain) connected to the data line $Col_j$. The storage capacitor Csto is connected between the other electrode of the transistor T1 and a reference voltage, typically ground. When the selection line $L_i$ is activated, the transistor becomes similar to a short-circuit, allowing the storage capacitor Csto to be charged up to the voltage level $V_D$ applied to the column and representing the data bit D to be displayed. Subsequently, the selection line is deactivated and the transistor returns to the non-conducting state. The data bit D is stored in the capacitor Csto.

When all the selection lines of the matrix have been successively activated, all the data of the frame are stored in the matrix write devices. Each pixel element now has a voltage level corresponding to the data to be displayed on this element.

Such a system does not work in colour sequential mode. Indeed, for each frame corresponding to an image, it is necessary to sample the data relative to the colour red, then transfer it onto the pixel elements, do the same with the colour green, then the colour blue. The conventional colour sequential addressing method would cause, for example, the red colour data to be erased in favour of the green colour data during the green illumination time. The result would be an unacceptable loss of calorimetric information.

It is therefore indispensable to have, at the level of each pixel, at least two sample-and-hold devices in series, as illustrated in FIG. 2. The first sample-and-hold device (transistor T1) is used according to the mode described previously in order to sample the information on an intermediate storage capacitor $CSto_A$ (sampling capacitor). The second sample-and-hold device (transistor T2) is activated for all the pixels at the end of each colour frame in order to transfer the information between the sampling capacitor $CSto_A$ and a storage capacitor $CSto_B$ where it will remain valid over the whole colour frame.

The pixel model in FIG. 2 has a major defect that makes it difficult to use. The voltage sampled is diluted over the two capacitors $CSto_A$ and $CSto_B$ during the transfer at the end of the colour frame. This voltage dilution is unacceptable for an LCD screen with an active matrix on silicon, since it imposes the use of addressing voltages that are incompatible with the capabilities of the transistors.

New write devices have thus been developed with associated drivers in order to improve the write performance of the display. In these devices, the two samplers T1, T2 have been doubled on each of the pixels such that, one frame in two, the sampling capacitor also serves as storage capacitor. This results in almost no voltage dilution during the transfer.

In order to differentiate the control of each of the samplers, the selection line has been doubled up in the structure of the matrix. Accordingly, as shown in FIG. 3, there are two selection lines $LA_i$ and $LB_i$ for each row i of the matrix. The lines $LA_i$ form a first group A of selection lines of the matrix. The lines $LB_i$ form a second group B of selection lines of the matrix. The write device is doubled up in the same fashion, one $WA_{i,j}$ to be controlled by the selection line $LA_i$, the other $WB_{i,j}$ to be controlled by the selection line $LB_i$. The addressing driver must control twice as many lines, with commands that alternate depending on the frame.

For example, on one frame, if the frame signal $Latch_A$ is at 1 and the frame signal $Latch_B$ is at 0, it activates the lines $LB_I$ of the group B, one after another, in order to sample the data of a new frame, while the contact is established between the information stored during the previous frame in the write devices $WA_{i,j}$ of the group A and the pixel elements. When the frame signal $Latch_A$ becomes 0 and the frame signal $Latch_B$ becomes 1, it activates the lines $LA_i$ of the group A, one after another, in order to sample the data of a new frame, while the contact is established between the information stored during the previous frame in the write devices $WB_{i,j}$ of the group B and the pixel elements. In summary, the signals $Latch_A$ and $Latch_B$ are frame indicator signals. Depending on these signals, the driver applies these activation signals, generally supplied by a shift register, towards the group A or the group B of the selection lines. This solution however turns out to be very bulky, since it multiplies the number of matrix lines by two, with all the problems of layout, of intersections with other signals and of space requirements that this implies. It also multiplies the number of line driver circuits by two.

SUMMARY OF THE INVENTION

A subject of the invention is a matrix display of reduced size.

Another subject of the invention is a matrix display designed for a colour sequential display mode which does not involve the doubling up of the rows or of the columns of the matrix.

The basic idea of the invention is to use two write devices with crossed controls.

Another basic idea of the invention is to use, for the pixels of a row, the selection line associated with that row and another selection line of the matrix for controlling both write devices with crossed control of each pixel element. Advantageously, this other selection line is the next line. For the last row of the matrix, it will be an additional line. In this way, the number of additional connection lines is significantly reduced. Moreover, few additional switching elements are required in order to form the crossed control. A competitive display system of reduced size is obtained.

Accordingly, the invention relates to a liquid crystal matrix display, comprising:

- a matrix of pixel elements, each pixel element being associated with a selection line and a data line of the matrix;
- a matrix driver delivering at least a first frame selection signal and a second frame selection signal;
- a first write device and a second write device associated with each pixel element of the matrix, the said write devices being of the type with crossed sampling and transfer commands, the first frame selection signal causing the sampling in the first write device and the contacting of information already sampled in the second write device with the pixel element, the second frame selection signal causing the sampling in the second write device and the contacting of information already sampled in the first write device with the pixel element,
- a write device being connected to the associated selection line of the pixel element, and the other device being connected to another selection line of the matrix.

The first frame selection signal and the second frame selection signal are mutually inverted binary signals.

According to a mode of operation designed to be used in a system for modifying all the points of an image simultaneously on a matrix display, the driver inverts the levels of the said first frame selection signal and second frame selection signal at each new frame.

According to another mode of operation designed to be used in a projection system comprising a matrix display designed for use in colour sequential mode, the driver inverts the levels of the said first frame selection signal and second frame selection signal at each new colour frame.

BRIEF DESCRIPTION OF THE DRAWINGS

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention.

Accordingly, the drawings and description thereof are to be regarded as illustrative in nature, and not as restrictive.

DESCRIPTION OF THE PREFER EMBODIMENTS

Figure 3:
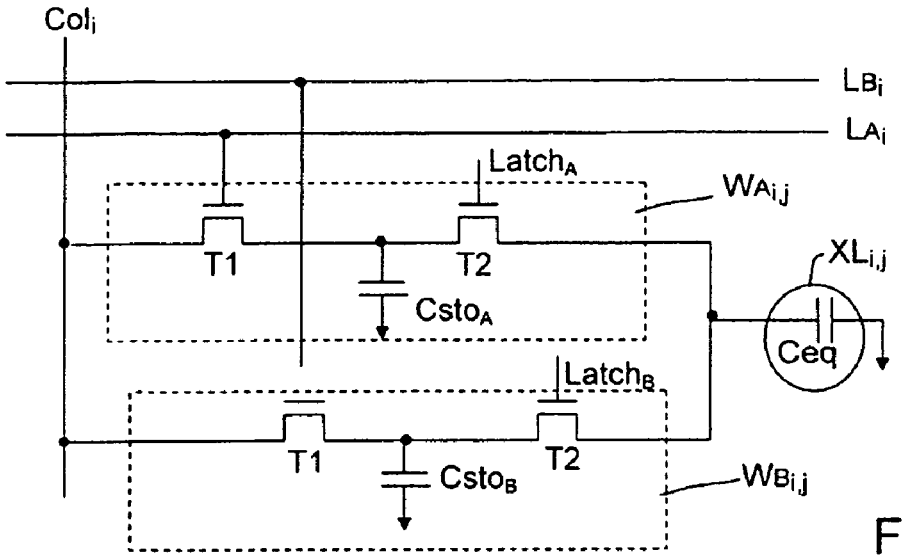
FIG. 3, already described above, shows a write device according to the prior art allowing a colour sequential display control.

Pixel elements $XL_{i-1,j}$, $XL_{i,j}$, $XL_{i+1,j}$, of a matrix display and their associated write devices are shown in FIG. 3.

With each pixel element is associated a first write device and a second write device with crossed sample and transfer commands, controlled by frame selection signals $Latch_A$ and $Latch_B$, one of the devices being associated with the selection line of the pixel element in question, the other device being associated with another selection line of the matrix.

Figure 4:
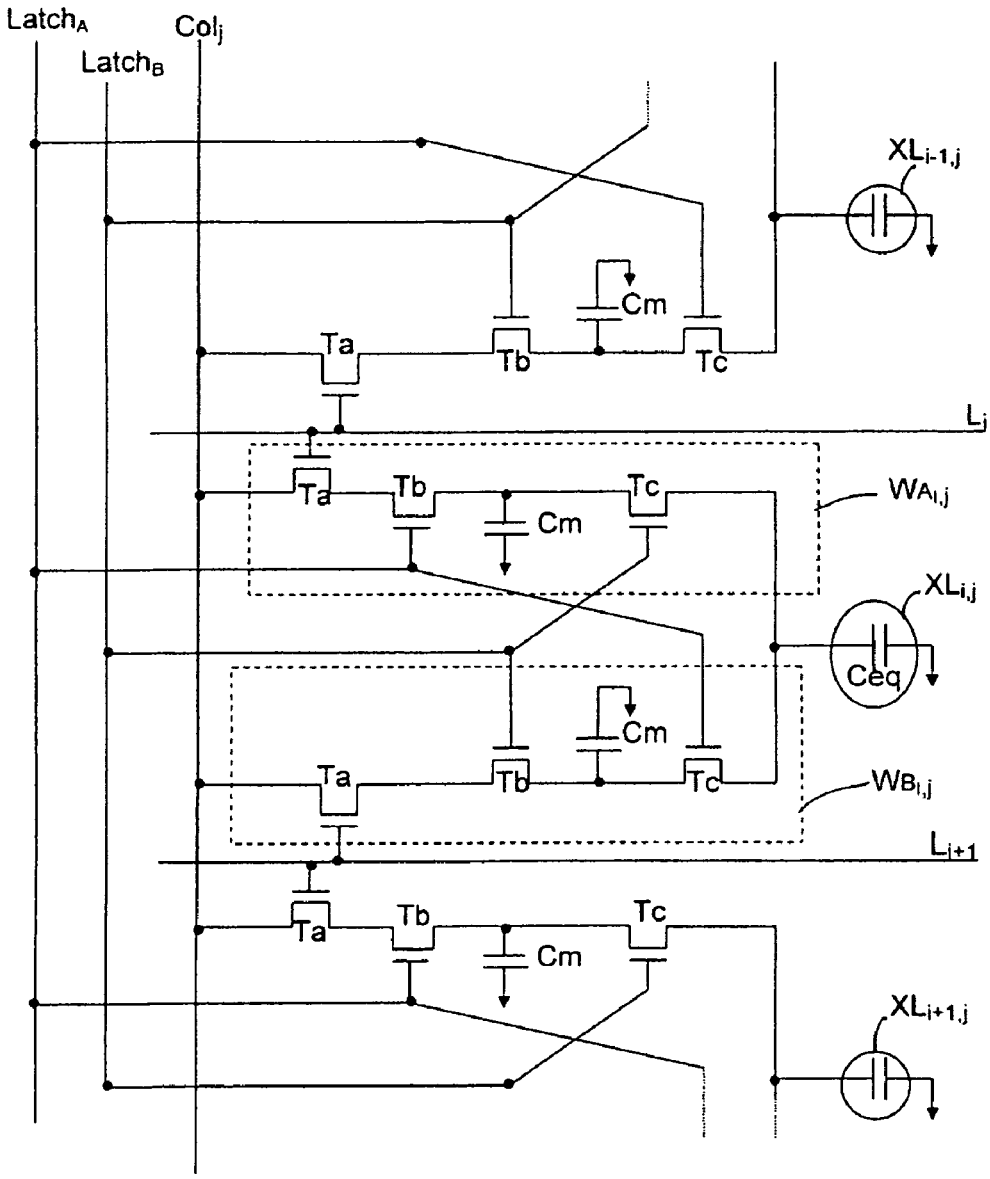
FIG. 4 shows a write device according to the invention allowing a colour sequential display control.

More precisely, if the pixel element $XL_{i,j}$ shown in FIG. 4 is considered, a first write device $WA_{i,j}$ is provided, connected between the data line $Col_j$ and the pixel element. This device is selected by activating the selection line $L_i$ of the pixel element. It is activated for the sampling of the data bit presented on the data line $Col_i$, by the first frame selection signal $Latch_A$, and it is data-transfer commanded by the second frame selection signal $Latch_B$.

A second write device $WB_{i,j}$ is provided, connected between the data line $Col_j$ and the pixel element. This device is selected by activating the next selection line, $L_{i+1}$. It is sampling activated with regard to the data bit presented on the data line $Col_j$ by the second frame selection signal $Latch_B$, and it is data-transfer commanded by the second frame selection signal $Latch_A$.

In each device, the sampling command and the transfer command are mutually exclusive. When a sampling command is sent to a device, the other device receives a transfer command and vice versa. More particularly, in one exemplary embodiment and as illustrated in FIG. 4, each write device comprises a first switching transistor Ta, whose gate is connected to the associated selection line and one electrode of which is connected to the associated data line. This first transistor is connected in series with a second transistor Tb, whose gate is controlled by one of the two frame selection signals. This second transistor has one electrode connected to an electrode of the first transistor and the other electrode connected to a storage capacitor Cm connected to a voltage reference, typically ground. The sampled data is stored on this capacitor. A third transistor Tc is connected between the capacitor and the pixel element. It is controlled on its gate by the other frame selection signal. It allows the charge to be transferred between the storage capacitor Cm and the equivalent capacitance Ceq of the pixel element.

More generally, in each write device there is a first switching circuit Ta, a second switching circuit Tb and a third switching circuit Tc connected in series between the data line $Col_j$ and the pixel element $XL_{i,j}$, and a storage capacitor Cm, of which one terminal is connected between the said second and third switching circuits Tb and Tc and another terminal to a voltage reference element. In the example, the switching circuits are MOS transistors. However, any other appropriate semiconductor switching device may be used, depending in particular on the technology used.

Figure 1:
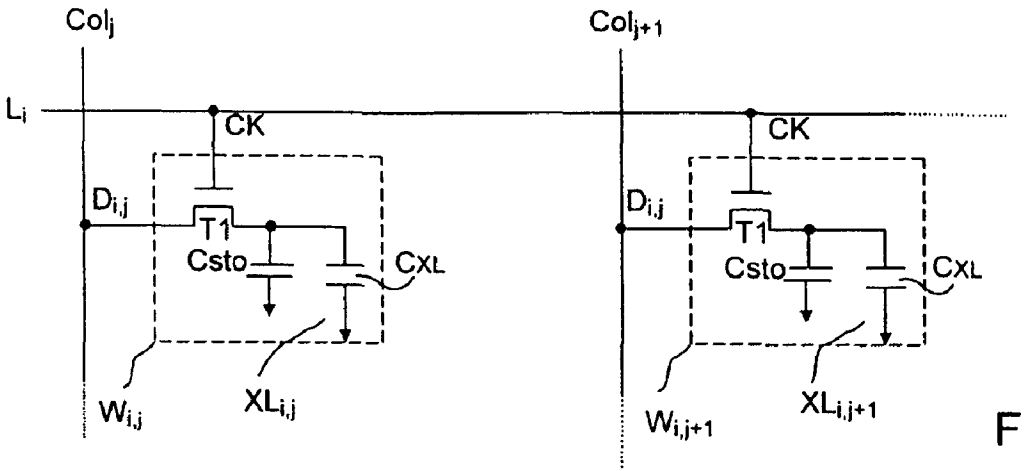
FIG. 1, already described above, shows a write device of a conventional matrix display.
Figure 2:
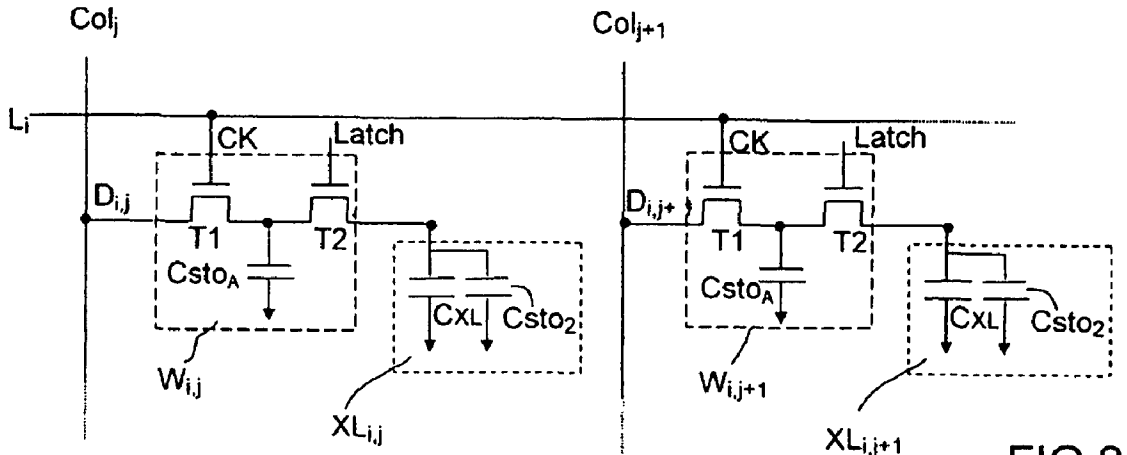
FIG. 2, already described above, shows a single sample-and-hold per pixel.

Compared with the structure of the prior art described in relation to FIGS. 1, 2 and 3, the structure of the invention only requires one additional connection line, in order to connect the second write device of the last row of the matrix to the selection line of the first row of the matrix. It costs two extra transistors per device, but in terms of surface area occupied, this is negligible with respect to the doubling up of the lines in the structure of FIG. 3.

Furthermore, another benefit is a reduction of the leakages in the capacitance Ceq by the two transistors Ta and Tb.

Figure 5:
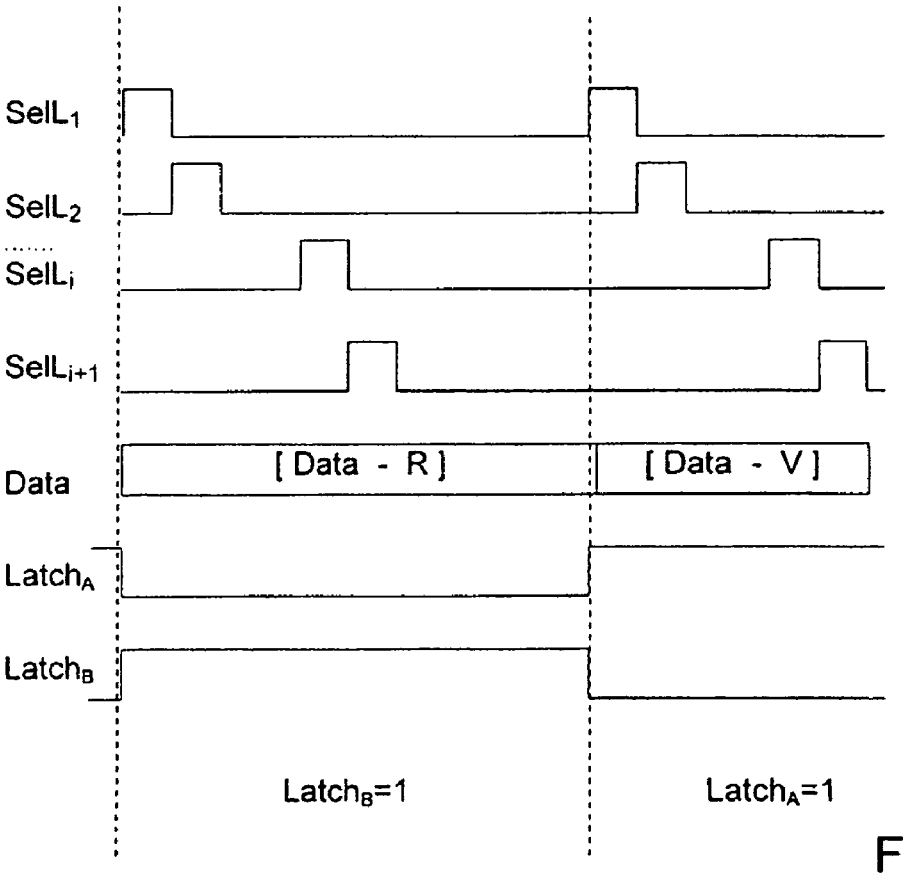
FIG. 5 is a timing diagram of the control signals of a display according to the invention.

The mode of sequencing of a matrix display according to the invention is detailed in FIG. 5.

The frame selection signals are mutually opposing binary signals, of binary state 0 or 1.

In a first sequence, if $Latch_A$=0 and $Latch_B$=1, the data applied to the columns by an associated driver are sampled and stored successively in each row i of pixel elements, in the write devices $WB_{i,j}$ activated by the next selection line $L_{i+1}$ of this row, while the data stored during the previous frame in the write devices $WA_{i,j}$, controlled by the selection line $L_i$ of this row i, are transferred into the pixel elements $XL_{i,j}$ of the row.

In a following sequence, $Latch_A$=1 and $Latch_B$=0, the data applied to the columns by the associated driver are sampled and stored successively in each row i of pixel elements, in the write devices $WA_{i,j}$ controlled by the selection line $L_i$ of this row, while the data stored during the previous frame in the write devices $WB_{i,j}$ activated by the next selection line $L_{i+1}$ of this row i, are transferred into the pixel elements $XL_{i,j}$ of the row.

When the sampling command is effected by the frame selection signal $Latch_B$, the row selection signal emitted by the driver which will activate the transistor Ta of the device $WB_{i,j}$ (by a shift register) and allow the sampling is the selection signal that is emitted onto the following row i+1. From FIG. 5, in the first sequence, the signal $SelL_1$ triggers the sampling on the last n-th row of the matrix, the signal $SelL_2$ triggers the sampling on the first row of the matrix, the signal $SelL_{i+1}$ triggers the sampling on the i-th row of the matrix and so on.

When the sampling command is effected by the frame selection signal $Latch_A$, it is the row selection signal emitted by the driver which will activate the transistor Ta of the device $WA_{i,j}$ (by a shift register) and allow the sampling. Again with regard to FIG. 5, in the second sequence, the signal $SelL_1$ triggers the sampling on the first row 1 of the matrix, the signal $SelL_2$ triggers the sampling on the second row of the matrix, the signal $SelL_i$ triggers the sampling on the i-th row of the matrix and so on.

In practice, this can be managed either at the row driver level, by staggering the signals appropriately, or at the column driver level, by appropriately staggering the sets of data to be displayed, such that the data of the correct row is always sampled.

It will be noted that, although in the example illustrated in FIG. 4 the line $L_i$ and the next line $L_{i+1}$ have been used to control the write devices of the pixel elements of the i-th row, the line $L_i$ and the line $L_{i-1}$, or any other line different from $L_i$, could just as well be taken. One advantage of taking an immediately adjacent line, $L_{i+1}$ or $L_{i-1}$, resides in the simplicity of connection and of management.

More generally, the invention applies to a system for modifying all the points of an image simultaneously on a matrix display comprising a driver according to the invention. At each new frame, the frame selection signals $Latch_A$ and $Latch_B$ are inverted in order for the information stored in the preceding frame to be displayed, and to sample the information corresponding to the new frame.

In order to display a colour image by means of a matrix display according to the invention, for each frame corresponding to an image, a colour sequential driver will apply a colour frame for each colour, typically a red frame, a green frame and a blue frame. At each new colour frame, the frame selection signals $Latch_A$ and $Latch_B$ are inverted, in order for the information that was stored during the preceding colour frame to be displayed, corresponding to the colour with which it is illuminated, and to sample the information corresponding to the new colour frame, within the same period.

Although more particularly adapted to the use of matrix displays of the LCOS type that are more particularly targeted in the applications concerned, such as video projection systems and virtual reality systems, the invention can be applied to any type of display that it would be desirable to want to control according to the principles presented in the invention.

Figures 6, 7:
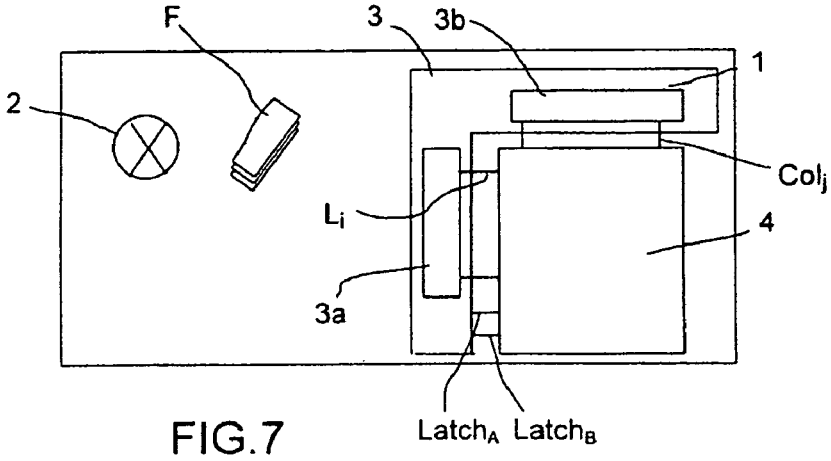
FIG. 6 is a table recapitulating a corresponding control sequence.
FIG. 7 is a schematic representation of a projection system using a matrix display according to the invention.

A projection system 1 using such a matrix display 4 will typically comprise, as shown schematically in FIG. 7, a white light source 2, typically of 500 watts.

The system comprises a driver 3 for the display 4, delivering the frame selection signals $Latch_A$ and $Latch_B$ according to the invention and formed from a driver 3*a* for the selection lines and from a driver 3*b* for the data lines.

In the case of a colour video image projection system, the system additionally comprises colour filters F. The display is sequentially illuminated with red, green then blue light, by means of the filters. It is controlled in an appropriate manner by the driver using the frame selection signals $Latch_A$ and $Latch_B$, in order to display the information stored at the preceding colour frame, corresponding to the colour with which it is illuminated, and to sample the information corresponding to the new colour frame.

The invention can be applied to other systems. It can notably be applied to a video system comprising such a projection system, for virtual reality applications.

It will be readily seen by one of ordinary sill in the art that that the present invention fulfills all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalent thereof

The invention claimed is:

1. A liquid crystal matrix display, comprising:

a matrix of pixel elements, each pixel element being associated with a selection line and a data line of the matrix;

a matrix driver to deliver at least a first frame selection signal and a second frame selection signal; and a plurality of first write devices, each of the plurality of first write devices being associated with a corresponding pixel element, a control terminal of each first write device being directly connected to a selection line of the corresponding pixel element;

a plurality of second write devices, each of the plurality of second write devices being associated with the corresponding pixel element, a control terminal of each second write device being directly connected to a selection line of another pixel element of another matrix row, the first and second write devices including crossed sampling and transfer commands, the first frame selection signal causing sampling in the first write device and contacting of information already sampled in the second write device with the pixel element, the second frame selection signal causing sampling in the second write device and the contacting of information already sampled in the first write device with the pixel element.

2. A matrix display according to claim 1, wherein the first frame selection signal and the second frame selection signal are mutually inverted binary signals.

3. A matrix display according to claim 2, wherein the matrix driver inverts levels of the first frame selection signal and second frame selection signal at each new frame.

4. A matrix display according to claim 2, wherein the matrix driver inverts levels of the first frame selection signal and second frame selection signal at each new color frame.

5. A matrix display according to claim 1, wherein each of the first and second write devices comprises a first, a second, and a third switching circuit connected in series between the data line and the pixel element, and a storage capacitance of which one terminal is connected between the second and third switching circuits and another terminal to a reference voltage element.

6. A matrix display according to claim 5, in which the switching circuits are transistors.

7. A system for modifying all points of an image simultaneously on a matrix display according to claim 3, wherein the frame selection signals are inverted at each new frame to cause information stored at a preceding frame to be displayed, and to sample information corresponding to a new frame.

8. A projection system comprising a matrix display according to claim 4, configured to be used in a color sequential mode, wherein the frame selection signals are inverted at each new color frame.

9. A projection system according to claim 8, comprising a white light source and color filters, the display being sequentially illuminated with red light, with green light, and with blue light, according to a pre-determined sequence by the color filters, and the driver configured to display the information stored at the preceding color frame, corresponding to the color with which the display is illuminated.

10. A video image display system comprising a projection system according to claim 4.

11. A virtual reality system comprising a projection system according to claim 4.

12. The liquid crystal display matrix according to claim 1, wherein first and second write devices of a same pixel element have at least one connection to a same selection line.

13. The liquid crystal display matrix according to claim 5, wherein a second switching circuit of a first write device associated with a pixel element and a third switching circuit of a second write device associated with the pixel element are connected to a same selection line.

14. The liquid crystal display matrix according to claim 13, wherein a third switching circuit of the first write device associated with the pixel element and a second switching circuit of the second write device associated with the pixel element are connected to a same selection line.

15. A liquid crystal matrix display, comprising:

a matrix of pixel elements, each pixel element being associated with a selection line and a data line of the matrix;

a matrix driver to deliver at least a first frame selection signal and a second frame selection signal; and a plurality of first write devices, each of the plurality of first write devices being connected between a data line and a corresponding pixel element, a control terminal of each first write device being directly connected to a selection line of the corresponding pixel element;

a plurality of second write devices, each of the plurality of second write devices being connected between the data line and the corresponding pixel element, a control terminal of each second write device being directly connected to a selection line of another pixel element of another matrix row, the first and second write devices including crossed sampling and transfer commands, the first frame selection signal causing sampling in the first write device and contacting of information already sampled in the second write device with the pixel element, the second frame selection signal causing sampling in the second write device and the contacting of information already sampled in the first write device with the pixel element.

* * * * *